US009711005B2

(12) United States Patent
French

(10) Patent No.: US 9,711,005 B2
(45) Date of Patent: Jul. 18, 2017

(54) MOBILE GAMING SYSTEM

(71) Applicant: TCS Jon Huxley Europe Limited, London (GB)

(72) Inventor: Nicholas Richard Baker French, Heslington (GB)

(73) Assignee: TCS Jon Huxley Europe Limited, London (GB)

( * ) Notice: Subject to any disclaimer, the term of this patent is extended or adjusted under 35 U.S.C. 154(b) by 124 days.

(21) Appl. No.: 14/161,136

(22) Filed: Jan. 22, 2014

(65) Prior Publication Data

US 2014/0206436 A1 Jul. 24, 2014

Related U.S. Application Data

(60) Provisional application No. 61/756,263, filed on Jan. 24, 2013.

(51) Int. Cl.
*G07F 17/32* (2006.01)

(52) U.S. Cl.
CPC ..... *G07F 17/3244* (2013.01); *G07F 17/322* (2013.01); *G07F 17/3218* (2013.01)

(58) Field of Classification Search
CPC . G07F 17/3218; G07F 17/322; G07F 17/3244
See application file for complete search history.

(56) References Cited

U.S. PATENT DOCUMENTS

2002/0103027 A1 8/2002 Rowe et al.
2003/0232651 A1 12/2003 Huard et al.
2006/0160599 A1* 7/2006 Tulley ..... G07F 17/32 463/16
2006/0287103 A1 12/2006 Crawford et al.
2007/0087832 A1 4/2007 Abbott et al.
2009/0075724 A1 3/2009 Breeding et al.
2010/0087241 A1* 4/2010 Nguyen ..... G07F 17/3218 463/17
2010/0120487 A1 5/2010 Walker et al.
2010/0244380 A1 9/2010 Walker et al.

FOREIGN PATENT DOCUMENTS

EP 2469489 6/2012
WO 03027970 4/2003
WO 2010039414 4/2010

OTHER PUBLICATIONS

International Search Report of PCT Application No. PCT/GB2014/000022 dated Jun. 20, 2014, 4 pages.

* cited by examiner

*Primary Examiner* — Damon Pierce
(74) *Attorney, Agent, or Firm* — Lowenstein Sandler LLP

(57) ABSTRACT

A gaming apparatus comprising a number of mobile gaming devices and gaming means to provide wagering games to players using the mobile gaming devices. The apparatus comprises at least one credit entering device for entering credit in association with the respective mobile devices, wherein the credit entering device has means for detecting the identity of a mobile device presented to it for crediting and means for receiving a credit amount to be associated with the presented mobile gaming device, and wherein the gaming means includes a memory for storing a respective credit amount in association with identifying data of each respective mobile gaming device.

13 Claims, 7 Drawing Sheets

MOBILE GAMING SYSTEM

CROSS-REFERENCE TO RELATED APPLICATION

This application claims priority to provisional application 61/756,263, filed Jan. 24, 2013, titled "Mobile Gaming System," and is hereby incorporated by reference in its entirety.

FIELD OF THE INVENTION

The present invention relates to gaming apparatus.

BACKGROUND OF THE INVENTION

The present gaming apparatus has been devised in order to address the problems of how to provide additional functionality to mobile gaming systems and how to incorporate a mobile gaming device into a group gaming environment and enable ongoing games to be continued without interruption.

SUMMARY OF THE INVENTION

The apparatus described herein is a flexible apparatus having dual functionality that enables playing of wagering games in both an environment where multiple players play a wagering game together and playing of wagering games at locations remote from that environment. The wagering game may be any casino game, such as roulette or a card game such as poker, blackjack, etc.

In a first playing mode, one or more players are seated round a gaming table and each player has a mobile gaming device docked to a docking station at the table. The table may have any convenient number of docking stations, but six or eight docking stations may be preferred. The table has a central display representing the game. The display may be a graphic depicting the wagering fields of a roulette table, and may show images of chips on the wagering fields, corresponding to bets placed by the players. Players seated round the table may place bets by entering wagering commands on their mobile gaming devices, and winnings are paid out by crediting the mobile gaming devices after each wheel spin (in the case of roulette) or hand of cards.

In a second playing mode, a player may release his mobile gaming device from the docking station at the table, and take it to another location, such as to a poolside or other seating area, or to a restaurant. The player may continue to participate in the game from this remote location, placing wagers using his mobile gaming device and observing the outcome of game events such as wheel spins or hands of cards on the display of the mobile gaming device.

In a first aspect, the invention relates to gaming apparatus having a gaming table and a plurality of mobile computer devices for playing wagering games taking place at the table, said apparatus being operable to detect the presence of the mobile devices at the table and to display at the table wagers placed by said detected mobile devices and being operable to permit the placing of wagers by said mobile devices when remote from said table.

In a second aspect, the invention relates to gaming apparatus comprising a plurality of mobile devices and gaming means for performing wagering game operations utilising wagers entered by means of said mobile devices, said apparatus further including at least one credit entering device for entering credit in association with respective different ones of said mobile devices, said credit entering device having means for detecting the identity of a said mobile device presented thereto, and for receiving a credit amount associated with said detected mobile device, said apparatus being operable to store said credit amount in association with the identity of the associated mobile device and to permit said wagering game operations by said mobile device utilising said stored credit.

In a third aspect, the invention relates to gaming apparatus comprising:

a plurality of mobile computer devices each having identification means uniquely identifying the device, a user interface for entering wagering data defining wagers for playing wagering games on the device, a credit store, and wireless telecommunication means for transmitting data to and receiving data from a wireless telecommunications network;

a gaming table for performing wagering events upon which wagers may be placed and having a plurality of player stations each being adapted to receive a respective one of said mobile devices and having means for detecting the identity thereof utilising said identification means;

display means for displaying at said table wagers placed on said wagering events;

server means having (a) means for storing data defining said wagering events performed at said gaming table, (b) means for storing, in association with the identity of each respective different one of said mobile computer devices, wagering data defining wagers on said wagering events placed by means of the associated mobile computer device and a credit value defining credit available for the playing of wagering games utilising said associated mobile computer device, (c) means for adjusting said credit value to a current credit value to take account of winning and losing wagers, placed utilising said associated mobile computer device, upon wagering events performed at said gaming table; and wherein said apparatus is operable:

(i) to transmit, to each said respective mobile devices via said wireless telecommunications network, said data defining wagering events and the current credit value associated with the respective mobile device, for display on said user interface;

(ii) to transmit, from each said mobile computer device to said server, said wagering data entered by said user interface, and (iii) to display on said display means the wagering data transmitted to said server from said mobile computer devices detected by said detecting means.

The invention also relates to a mobile apparatus or device adapted or configured for use in the gaming apparatus as described above. The mobile apparatus or device may be a portable laptop computer, a tablet computer, a smart phone or the like.

The invention also relates to a gaming table for use in the gaming apparatus as described above.

The invention also relates to a self-service credit entering means for use in the gaming apparatus as described above.

The invention will now be described by way of example only and without limitation by reference to the drawings, a brief description of which is provided below.

DETAILED DESCRIPTION

Embodiments of the invention will now be described with reference to the Figures.

Figure 1:
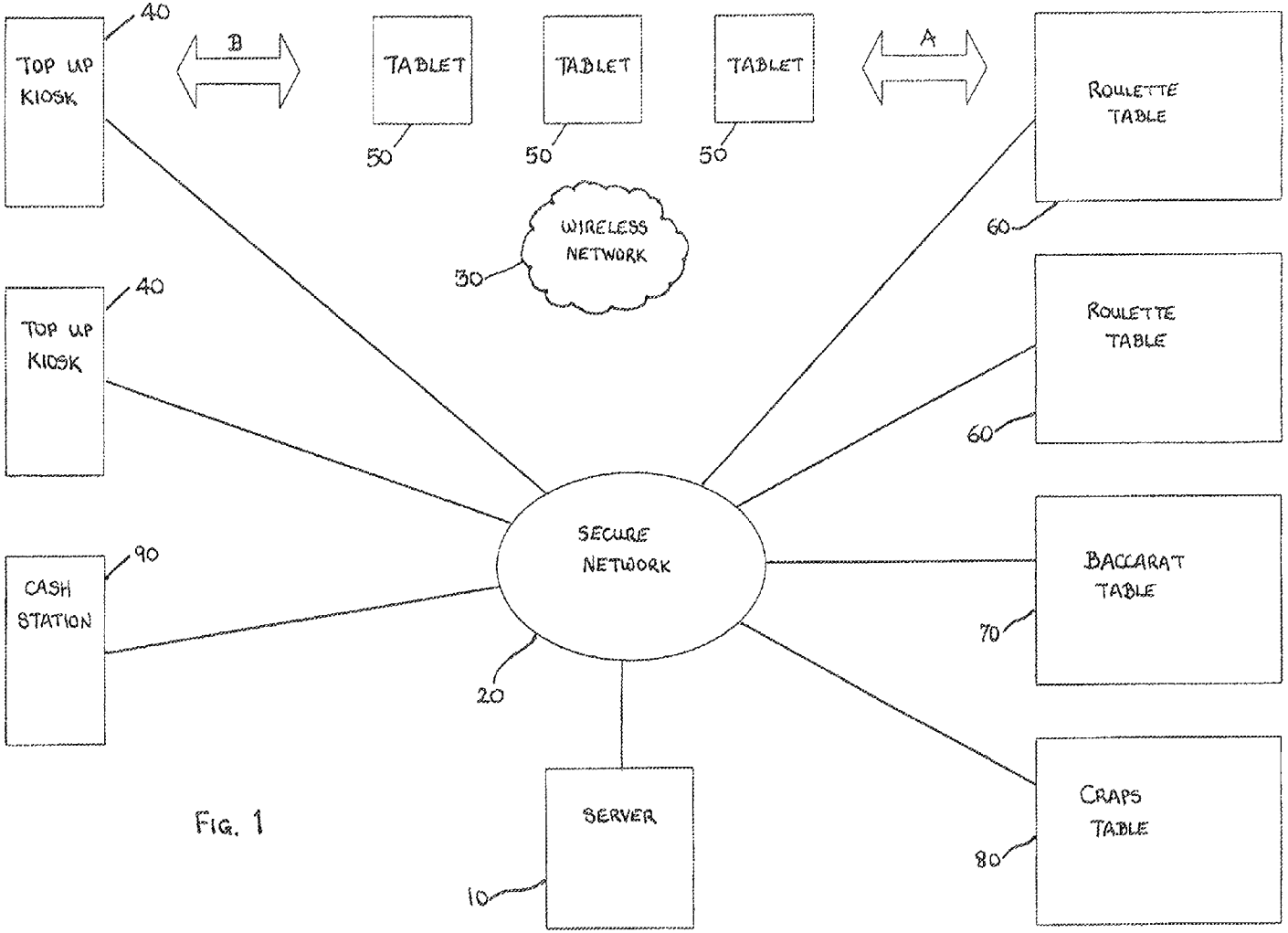
FIG. 1 is a block diagram of a gaming system in accordance with the invention.

FIG. 1 is a block diagram illustrating a gaming system in accordance with the invention. The system comprises a server 10 which communicates over secure telecommunications network 20 with a number of static devices in a casino. These static devices include roulette tables 60, baccarat table 70, craps table 80, a cash station 90 for enabling players to purchase credit for playing games with the assistance of a cashier, and a number of self-service top-up kiosks 40 for enabling players to purchase credit without the assistance of the cashier.

The system also includes a number of mobile gaming devices in the form of tablet computers 50 which are operable as terminals by means of which players may play gambling games. For this purpose, the tablet computers 50 include means for recording credit, obtained by means of the station 90 and/or the kiosks 40.

Each tablet computer 50 has assigned to it a unique identification code, which will be referred to as IDT1, IDT2 etc in the following description. In the described embodiment, the identification code is embodied in the form of an RFID tag which can be interrogated by an RFID reader to recover the unique identification code of the tablet computer 50.

The double headed arrow A in FIG. 1 denotes that the tablet computer 50 having the identification code IDT1 may be removably docked with a gaming table such as for example one of the roulette tables 60, the baccarat table 70, the craps table 80 or with another gaming table not shown in the Figure.

The tablet computers 50 incorporate conventional wireless data transmitters and receivers for transmitting and receiving data to and from a conventional Wi-Fi network 30, which is separate from the secure network 20. The server 10 is also provided with, or connected to, a conventional wireless data transmitter and receiver so that the server 10 and the tablet computers 50 can communicate with each other over the wireless network 30 independently of the secure network 20.

As will be described more fully below, the system is such that players can play games, particularly wagering games such as roulette, baccarat or craps, using the tablet computers whilst sitting at the gaming table but can also take their tablet computers away from the gaming table and continue to play the game carried on at the same table but in locations remote from the table, particularly locations in other parts of the casino premises.

If the credit on the player's tablet computer runs low, the player may top up the credit on the tablet using one of the self-service top-up kiosks 40 located around the casino, rather than returning to the cash station 90 for topping up by the cashier. The double headed arrow B in FIG. 1 denotes that the tablet 50 may be removably docked with one of the top-up kiosks 40 or with the cash station 90.

Figure 2:
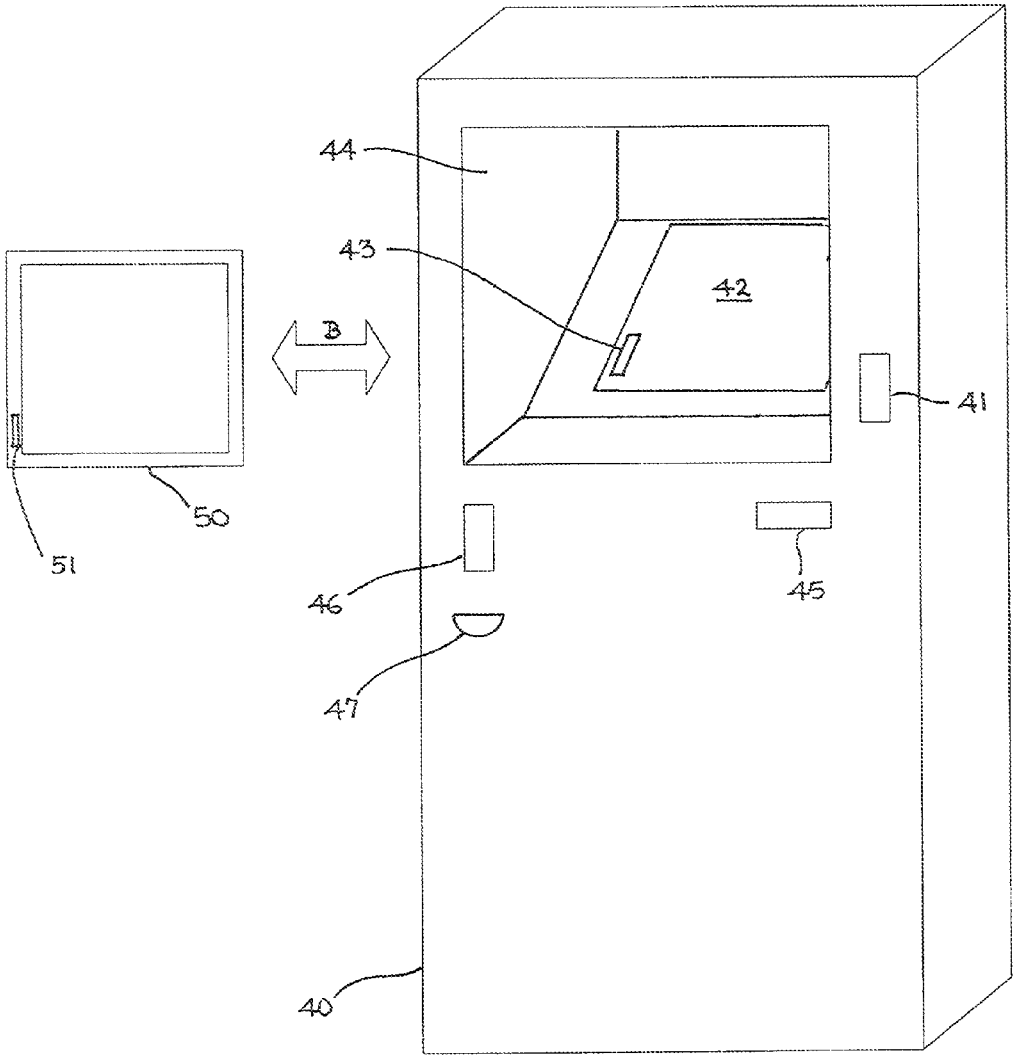
FIG. 2 is a diagrammatic perspective view of a self-service top-up kiosk, included in the system shown in FIG. 1.

Referring to FIG. 2, this shows a perspective view of a self-service top-up kiosk 40 for crediting funds to a mobile gaming device such as tablet computer 50. The tablet computer 50 is denoted as being removably dockable to the kiosk by double headed arrow B.

The self-service top-up kiosk 40 has a unique identification 41 encoded in software in a file in the kiosk's processor (not shown) which enables the kiosk to be identified to the server 10. The kiosk has a docking station 42 which, in this example, is a sloping platen formed in a recess 44 in the front face of the kiosk. The tablet computer 50 is docked to the kiosk 40 by placing the tablet computer 50 on the platen of the docking station 42. The docking station has an RFID reader 43 for reading the RFID tags of mobile gaming devices that are docked with the kiosk. Below the recess 44, the front face of the kiosk has a bill acceptor slot 45 for receiving bills or banknotes paid in by a user, a coin acceptor slot 46 for receiving coins paid in by a user, and a returned coin hatch 47 where bent or damaged coins are returned if they cannot be accepted in payment. In addition to the bill and coin accept orders, the kiosk may be provided with a credit card reader (not shown) for accepting payment by credit card.

In the Figure, the docking station 42 is shown as being of a size compatible with receipt of the tablet computer 50. In practice, the docking station may be configured to accept a variety of mobile gaming devices, including tablets of various sizes and aspect ratios, personal digital assistants (PDAs), smart phones or the like. In these circumstances, the platen of the docking station 42 may be provided with indicia to show the user how to orient each type and model of mobile gaming device when placing it in the docking station 42 so as to be certain that the RFID reader 43 is able to read the RFID tag 51 in the user's mobile gaming device.

Figure 3:
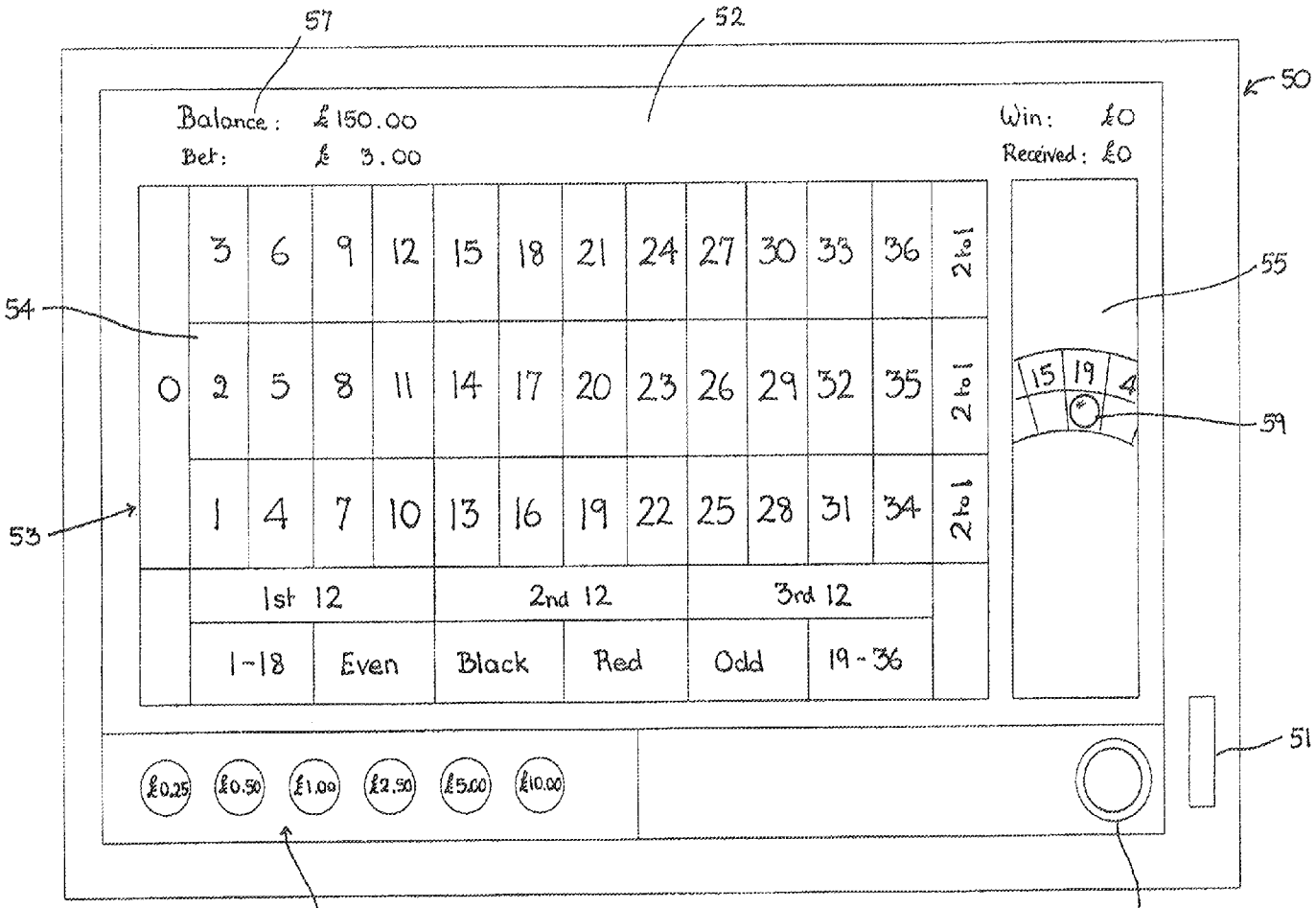
FIG. 3 is a diagram of a tablet gaming device included in the system of FIG. 1, and shows a typical display that a user sees during a game of roulette.

Referring now to FIG. 3, this illustrates a tablet computer 50, shown in this Figure with a display that is typical of the type that a user sees during a game of roulette.

Tablet computer 50 has a unique identifier IDT1 recoverable from RFID tag 51 which enables it to be identified. Any message sent by the tablet computer 50 to the server 10, or to any other component of the gaming system will include the unique identifier IDT1 to enable the message recipient to identify the originator of the message. Tablet computer 50 further includes a touchscreen 52. In the Figure, the touchscreen is showing a user interface 53 for a live roulette game. A betting area graphic 54 occupies most of the screen. The betting area graphic comprises a grid having a field for each of the numbers 0 to 36, fields for the first second and third dozen (1 to 12, 13 to 24, and 25 to 36), fields for the lower and upper halves (1 to 18 and 19 to 36), fields marked "2-to-1" for the first second and third columns, and fields for "even", "odd", "black" and "red". As is conventional, on the grid the field for the zero is coloured green, the fields for the numbers 1, 3, 5, 7, 9, 12, 14, 16, 18, 19, 21, 23, 25, 27, 30, 32, 34 and 36 are coloured red, and the fields for the remaining numbers are coloured black. Adjacent fields are separated by lines, and the lines meet at intersections.

Bets are placed using the same conventions as in the physical game of roulette. For example, if a player wishes to bet only on the number 3 then he touches the field F corresponding to the number 3. If the player wishes to bet on the numbers 9 and 12, he touches the line L which separates the fields corresponding to the numbers 9 and 12. If the player wishes to bet on the numbers 14, 15, 17 and 18, he touches the intersection I where the four fields numbered 14, 15, 17 and 18 meet.

To the right of the betting area graphic 54 is a result graphic 55 which, in this view, shows that the roulette ball 59 has come to rest in the pocket corresponding to number 19. To the bottom left of the betting area graphic 54 is a row of wager amount icons 56. To select a wager amount before placing a bet, the user touches one of the icons which then becomes lit whilst the other icons in the row remain greyed out to differentiate them from the selected wager amount icon. When the user wishes to change his wager amount, he touches another of the icons which then becomes lit to indicate the new selected wager amount. The previously selected wager amount icon becomes greyed out. Beneath the result graphic 55 is a chip colour indicator icon 58, the purpose of which will be explained below. When an amount to be wagered has been selected, the player places the bet by touching the appropriate field, line between two fields, or intersection of two lines on the touchscreen.

In a physical roulette game, played with wagering chips, the chips usually have no value denomination marked on them. Instead, the game is played with different coloured chips and a respective colour of chip is assigned to each individual player at the table. When the player buys-in, he is assigned his own colour of chip, and the value of an individual chip is determined by dividing his buy-in amount by the number of chips that he receives. For example, if a player buys 100 chips for £500, each of his chips is worth £5. If, however, the player buys 10 chips for £500, then each of his chips is worth £50. The croupier records the value amount of a particular player's chips. One of the consequences of this scheme is that the number of players at the table cannot exceed the number of different colours of chips available at the table. For example, if there are only six colours of chips available, then only six players can play at the table.

When a player is playing a roulette game on tablet computer 50 in an area away from the roulette table, the betting area graphic 54 on his tablet computer 50 may show his own bets in a colour of his choice, or in a colour corresponding to his wager amount. The betting area graphic 54 may also show bets placed by other players either at the table or playing in the game via their respective tablet computers 50 from other locations. The bets placed by players seated at the table may be shown on his tablet computer 50 in the colours allocated to those players at the table, and the bets placed by players who are playing from remote locations may be shown on his tablet computer 50 in another colour, different from the table players' colours and different from the colour used for bets placed by the player himself.

However, if the player is playing a roulette game at the roulette table with his tablet computer 50 to one of the docking stations 65 of the table, his bets will be displayed as chips on the communal betting field (to be described below in relation to FIG. 4) of the roulette table. Therefore, his bets have to be assigned a particular chip colour for the purposes of the communal display. The colour assigned to his chips in these circumstances is displayed on the tablet computer 50 by the chip colour indicator icon 58 and may be determined by the docking station 65 at which the player is seated. Each docking station 65 may have its own dedicated colour. Alternatively, the player may be given a choice of colours to select from, software in the table computer ensuring that no two players at the table may select the same colour.

Above the betting area graphic 54 there is a balance display 57 that indicates to the user how much available credit he has remaining on the tablet computer 50. This area of the screen may also include a bet total display which tells the user how much he has wagered on the current spin, a win total display which tells the user how much was won on the previous spin, and a received total display which tells the user the actual amount that was received, taking into consideration what the user staked on the winning combination.

Figure 4:
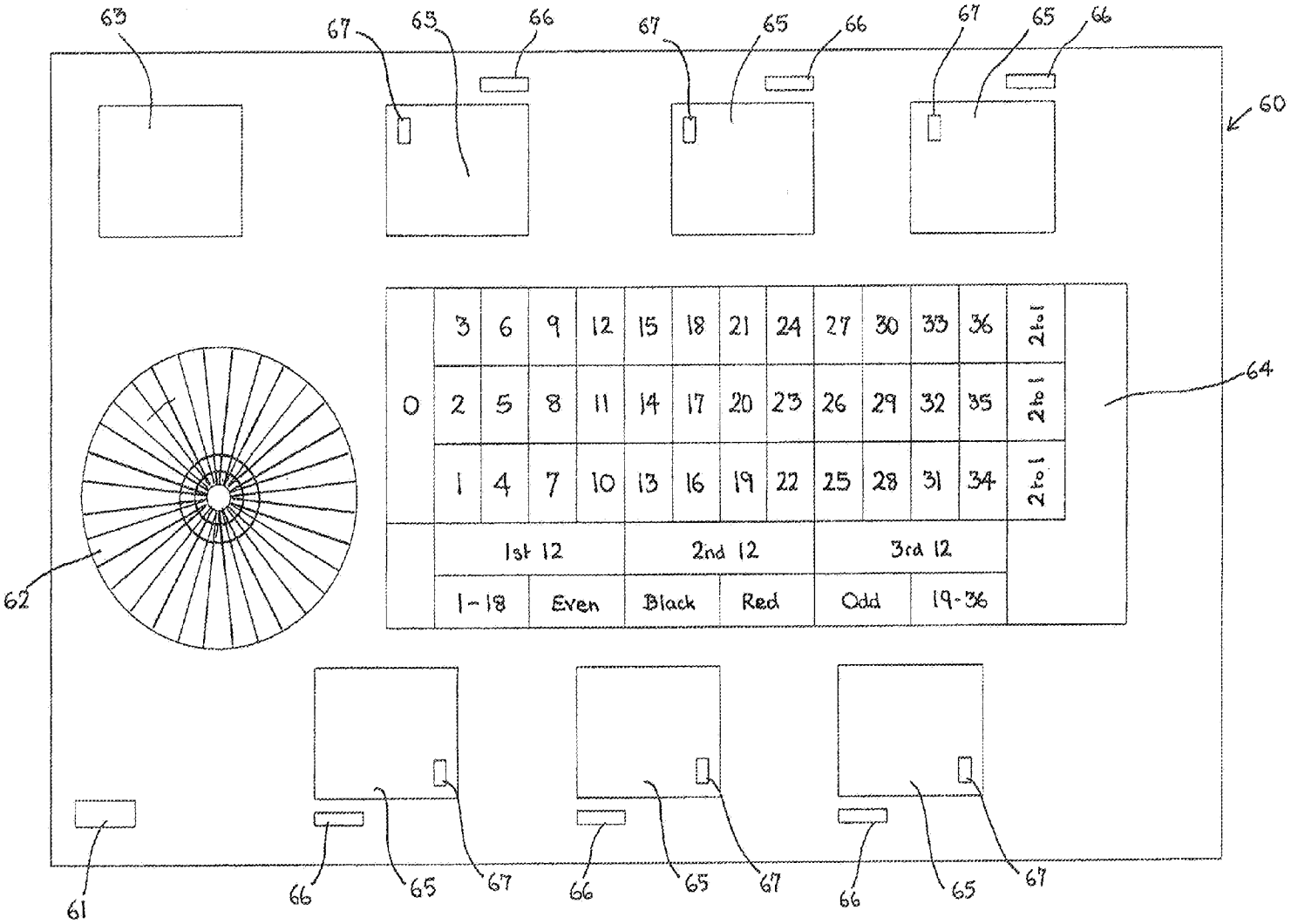
FIG. 4 is a plan view of a roulette table included in the system of FIG. 1.

Referring now to FIG. 4, this shows a plan view of a roulette table 60. The table has a unique identification IDR1 encoded in software in a file 61 in the table's processor (not shown). Any message sent from the table's processor to the server 10 will include the unique identification IDR1, which enables the table to be identified by the server 10. Likewise, messages intended for the tables processor will be addressed using the unique identification IDR1. Roulette wheel 62 may be a manually operated wheel or an automatic wheel. The result of each spin may be communicated to the table's processor by an input device operated by the croupier, or may be automatically detected by a result detector 63 which in turn sends a signal communicating the result of the spin to the table's processor. To the right of the roulette wheel 62 is a betting display area 64 which takes the place of the normal betting felt. The markings on the betting display area 64 are the same as those that would be provided on a normal betting felt. As the players make their wagers, the betting display area 64 may show the appropriately coloured chips placed at the appropriate locations on the betting grid to correspond to the wager amounts and selections made by each player.

Along each long side of the roulette table are three docking stations 65 (making a total of six docking stations around the table) for receiving mobile gaming devices such as tablet computers 50 for communal game play around the table.

Each docking station 65 has a unique docking station identification encoded in software in a file 66 in the docking station's processor (not shown) which enables each docking station to be identified to the server 10. Each docking station 65 also has an RFID reader 67 for reading the RFID tags of mobile gaming devices that are docked with it. Similarly to the docking station 42 of self-service top-up kiosk 40 described above, the docking stations 65 of the roulette table 60 may be configured to accept a variety of mobile gaming devices, including tablets of various sizes, personal digital assistants (PDAs), smart phones or the like. The docking stations 65 may be provided with indicia to show the user how to orient his mobile gaming device when placing it in the docking station so as to be certain that the docking station's RFID reader 67 can read the RFID tag in the user's mobile gaming device.

Optionally, the docking stations 65 may include means (not shown) for recharging the battery of a docked mobile gaming device.

Figure 5:
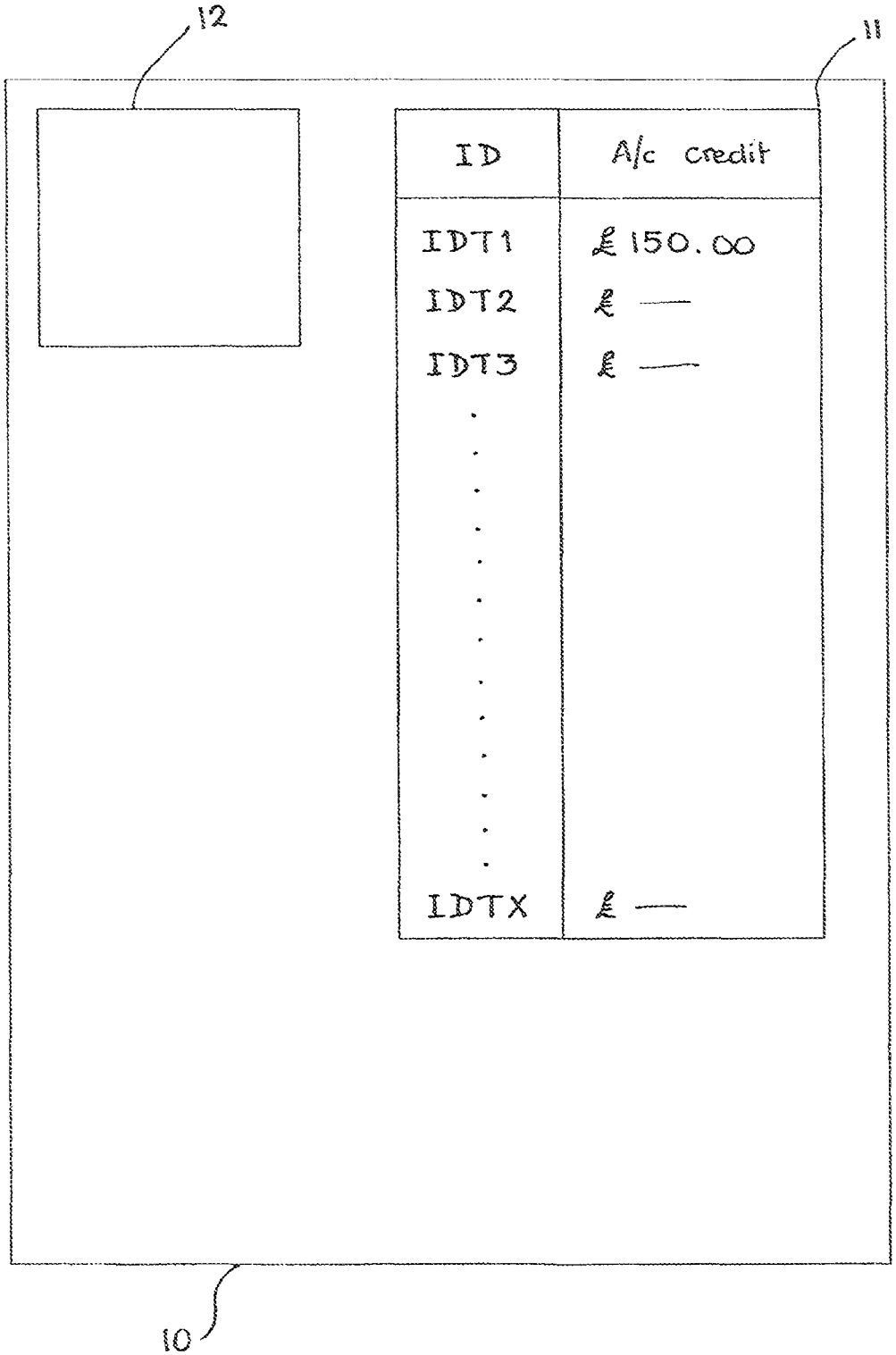
FIG. 5 is a block diagram showing some components of a server included in the system of FIG. 1.

Referring now to FIG. 5, this is a block diagram showing some components of the server 10. The server 10 has a mobile gaming device credit list 11 which is a table storing the credit assigned to the account of each mobile gaming device 50 uniquely identified in the table as IDT1, IDT2, IDT3, IDTX recognised by the system. The server 10 also has a game select list 12 accessible to the user through his mobile gaming device for selecting a game that he wishes to play.

System Component Functions

The server 10 stores the unique identities (IDT1, IDT2, etc) of each mobile gaming device operable with the mobile gaming system and the unique identities (IDR1, IDR2, IDB1 etc) of each static device, e.g., each gaming table 60, 70, each docking station 65 at each gaming table and at each docking station 42 at each self-service top-up kiosk 40. The store of unique identities is sorted into "types" so that the server can differentiate between mobile gaming devices 50, gaming tables 60, 70, docking stations 65 and also between different types of gaming tables, as well as between different types of docking stations, i.e., docking stations 65 at gaming tables, docking stations 42 at self-service top-up kiosks and docking stations at the cash station 90. Messages sent to the server across the secure network 20 by the static devices always include the unique identification of that static device.

When a credit is loaded onto a particular mobile gaming device, either at the cash station or at one of the self-service top-up kiosks, the server assigns that credit to the particular mobile gaming device in its mobile gaming device credit list 11.

A—Server and Kiosk Functions when Tablet Computer 50 is Docked with a Self-Service Top-Up Kiosk 40

A1. When the tablet computer 50 is docked with the self-service top-up kiosk 40, the RFID reader 43 of the kiosk reads the RFID tag 51 of the tablet computer and the kiosk sends a message to the server 10 over the secure network 20 indicating that the kiosk has a device having the unique identity IDT1 docked to it. The message from the kiosk includes its own unique identification (IDK1).

A2. The server 10 checks its store of unique identities and determines that the device having the identification IDT1 is a tablet computer and that it is docked with the device having the identification IDK1, which device is a self-service top-up kiosk.

A3. The server 10 sends a message to the tablet computer 50 across wireless network 30 causing the tablet computer to switch to a "credit receive" mode and to show a credit balance. The touchscreen 52 of tablet computer 50 may display a prompt to the user to insert cash into the kiosk 40.

A4. Banknotes or bills inserted into the kiosk 40 through its bill acceptor slot 45, or coins inserted into its coin acceptor slot 46, cause the kiosk 40 to send a message to the server 10 across the secure network 20 indicating to the server that it has received a cash payment, and indicating the amount received. The cash received at kiosk 40 is temporarily held in escrow.

A5. The server 10 notes that a kiosk 40 having the identification IDK1 has tablet computer 50 having the identification IDT1 docked to it.

A6. The server 10 sends a message back to the kiosk 40 having the identification IDK1 across secure network 20 causing the kiosk to put the cash received into its cashbox.

A7. When the kiosk has put the cash received into its cashbox, the kiosk sends a message including its identification IDK1 back to the server 10 across the secure network 20 confirming that it has put the cash received into its cashbox.

A8. The server 10 updates its mobile gaming device credit list 11 to show the new credit balance assigned to the device having the identification IDT1.

A9. The server 10 sends a message across the wireless network 30 to the tablet computer 50 having the identification IDT1 which causes the tablet computer 50 to adjust its credit balance, and to update the credit balance displayed on the tablet computer's touchscreen 52

A10. When the tablet computer 50 is undocked from the kiosk 40, the kiosk sends a message including its identification IDK1 to the server 10 across the secure network 20 indicating that the device having the identification IDT1 has been removed from the kiosk 40.

A11. The server 10 then sends a message across the wireless network 30 to the tablet computer 50 having the identification IDT1 causing the tablet's default display to be restored in place of the "credit receive" mode display.

B—Server and Tablet Functions when Tablet Computer 50 is Docked with a Self-Service Top-Up Kiosk 40

B1. When the tablet computer 50 having the identification IDT1 is docked with the kiosk 40 having the identification IDK1, the tablet may be running any application, such as a roulette game, a card game a dice game or an application concerned with booking restaurant or theatre tickets, etc. The mere act of docking with the kiosk does not affect the tablet computer's function.

B2. The tablet computer having the identification IDT1 receives a message from the server 10 across the wireless network 30 causing it to a adopt a "cash receive" mode.

B3. The tablet computer 50 display changes to show the current credit balance and the tablet computer awaits further messages from the server 10 across the wireless network 30. The display on the tablet computer 50 may also prompt the user to insert payment into the kiosk's receptors.

B4. When the tablet computer 50 having the identification IDT1 receives a message from the server 10 across the wireless network 30 with details of the new credit balance, the credit balance is updated on the tablet computer's display. The tablet computer awaits further messages from the server 10 across the wireless network 30.

B5. When the tablet computer 50 having the identification IDT1 is undocked from the kiosk 40 having the identification IDK1, the tablet computer display does not change.

B6. The tablet computer 50 having the identification IDT1 receives a message from the server 10 across the wireless network 30 causing the tablet computer's default display to be restored in place of the "credit receive" mode display.

C—Server and Roulette Table Functions when Tablet Computer 50 is Docked with Roulette Table 60

C1. The roulette table 60 having the identification IDR1 sends messages to the server 10 across the secure network 20 indicating the state of the roulette wheel 62. Permitted states are:

(a) "Place your bets"
(b) "Finish betting"
(c) "No more bets"
(d) "Result"

C2. When the tablet computer 50 having the identification IDT1 is docked with one of the docking stations 65 of the roulette table 60, the RFID reader 67 of the docking station 65 reads the RFID tag 51 of the tablet computer 50. The docking station has its own unique identification. The docking station 65 having the identification IDD1 sends a message including its identification IDD1 to the server 10 over the secure network 20 indicating to the server that it has a device having the identification IDT1 docked to it.

C3. The server 10 checks its store of unique identities and determines that the device having the identification IDT1 is a tablet computer and that it is docked with the device having the identification IDD1 which is a particular docking station at the roulette table having the identification IDR1.

C4. The server 10 sends a message across the secure network 20 to the processor of the roulette table having the identification IDR1 telling the roulette table that it has a device having the identification IDT1 docked at the roulette table's docking station 65 having the identification IDD1.

C5. The roulette table 60 having the identification IDR1 sends a message including its identification to the server 10 across the secure network 20 requesting the server to forward information about any bets for the current spin placed by the device having the identification IDT1 before the device became docked at docking station having the identification IDD1.

C6. If any bets had been placed by the tablet computer having the identification IDT1 for the current spin before it became docked at the docking station having the identification IDD1, the server 10 sends a message to the roulette table having the identification IDR1 across the secure network 20 with information about those bets and the roulette table causes the bets to be displayed on its betting display area 64.

C7. The roulette table having the identification IDR1 sends a message including its identification to the server 10 across the secure network 20 requesting from the server information about any bets for the current spin made by the device having the identification IDT1 since it became docked at the docking station having the identification IDD1.

C8. If any bets are placed by the tablet computer having the identification IDT1 for the current spin since it became docked at the docking station having the identification IDD1, the server 10 sends the information across the secure network 20 to the roulette table having the identification IDR1, and the roulette table displays the bets on its betting display area 64.

C9. The roulette table having the identification IDR1 displays on its betting display area 64 all bets for the current spin placed by the tablet having the identification IDT1. The bets are displayed on the betting display area as images of chips, whose colour corresponds to the docking station IDD1.

C10. For subsequent spins, the roulette table having the identification IDR1 receives messages from the server 10 across the secure network 20 about any bets placed by the tablet computer having the identification IDT1 and displays those bets on its betting display area 64.

C11. When the tablet computer having the identification IDT1 is undocked from the docking station having the identification IDD1, the docking station sends a message including its identification to the server 10 across the secure network 20 telling the server that its association with the device having the identification IDT1 has ended.

C12. The server 10 sends a message to the tablet computer having the identification IDT1 across the wireless network 30 telling the tablet computer that its association with the device having the identification IDD1 has ended.

C13. The server 10 sends a message to the roulette table having the identification IDR1 telling the roulette table that the association between its docking station having the identification IDD1 and the device having the identification IDT1 has ended. The message may instruct the roulette table to remove from its betting display area any bets placed by the device having the identification IDT1 for the current spin, or may instruct the roulette table to keep any bets placed by the device having the identification IDT1 but display them in its betting display area with a colour different from the colours of the chips corresponding to the docking stations of the table.

C14. As an alternative to the functions described above at C13, the server 10 may send a message to the roulette table having the identification IDR1 indicating that the association between docking station having the identification IDD1 and the device having the identification IDT1 has ended, but causing the roulette table to maintain on its betting display area any bets placed by the device having the identification IDT1 for the current spin. This option may be invoked if the occupancy of the docking stations 65 around the roulette table is incomplete so that there is no requirement to assign the departed player's chip colour to a new player.

D—Server and Tablet Functions when Tablet Computer 50 Docked at Roulette Table 60

D1. When the tablet computer 50 having the identification IDT1 is docked with the docking station 65 having the identification IDD1 of the roulette table 60 having the identification IDR1, the tablet computer may be running any app. The mere act of docking with the docking station does not affect the tablet computer's function.

D2. The tablet computer having the identification IDT1 receives a message from the server 10 across the wireless network 30 preparing the tablet computer to play a live roulette game.

D3. The display on the screen of the tablet computer having the identification IDT1 changes to show a representation of the roulette game at the roulette table having the identification IDR1 and showing the credit balance available for betting. The chip colour indicator icon 58 to the bottom right of the tablet computer's user interface 53 shows the colour that will be assigned to the user's chips when his bets are displayed on the betting display area 64 of the roulette table. The tablet computer 50 awaits further messages from the server 10 across the wireless network 30.

D4. When the tablet computer having the identification IDT1 receives a message from the server 10 across the wireless network 30 indicating that bets may be placed for a new spin of the roulette wheel 62 at the roulette table having the identification IDR1, a touch by the user of one of the wager amount icons 56 to the bottom left of the tablet user interface 53 is effective to select a wager amount for the user's bets. Further touches by the user of appropriate fields, lines or intersections of the betting area graphic 54 of the user interface 53 are effective to place bets on the outcome of the current spin.

D5. The tablet computer having the identification IDT1 sends messages to the server 10 across the wireless network 30 with information about the wager amounts and the selections which comprise the bets that have been placed for the current spin.

D6. The tablet computer having the identification IDT1 receives messages from the server 10 across the wireless network 30 causing the tablet computer to display an updated credit balance in the balance graphic 57.

D7. The tablet computer having the identification IDT1 receives a message from the server 10 across the wireless network 30 causing the tablet computer to display "Finish betting" on the user interface 53.

D8. The tablet computer having the identification IDT1 receives a message from the server 10 across the wireless network 30 causing the tablet computer to display "No more bets" on the user interface 53.

D9. The tablet computer having the identification IDT1 receives a message from the server 10 across the wireless network 30 causing the tablet computer to display the result of the current spin in the result graphic 55 of the user interface 53.

D10. If the user of the tablet computer having the identification IDT1 has placed a winning bet, the tablet computer having the identification IDT1 receives a message from the server 10 across the wireless network 30 causing the tablet computer to display the win amount to update the credit balance displayed in the balance graphic 57.

D11. When the tablet computer having the identification IDT1 is undocked from the docking station having the identification IDD1, the tablet computer receives a message from the server 10 across the wireless network 30 causing the tablet computer to grey out the chip colour indicator icon 58 to the bottom right of the user interface 53. Otherwise the tablet display does not change.

D12. The user can continue to play live roulette when his tablet computer is undocked. If the user wishes to end play or wishes to switch to another roulette table or to another type of wagering game, the user may select one of these alternatives from a menu displayed on his tablet computer. The tablet computer sends a message to the server 10 across the wireless network 30 indicating to the server 30 that a new game has been selected or that game play has ended.

D13. If a new game has been selected, the server 10 sends a message back to the tablet computer across the wireless network 30 causing the tablet computer to display graphics for the newly selected game on its touchscreen 52.

E—Server Functions During Game Play

E1. At commencement of a new gaming session (e.g., when the casino opens for the day), the server 10 sends a message to the roulette table having the identification IDR1 telling the table that the table is now open. The default condition for the roulette table having the identification IDR1 is "table closed" unless it receives a message from the server 10 telling the roulette table to change from its default condition to a "table open" condition.

E2. If the server 10 receives a message from the tablet computer having the identification IDT1 across the wireless network 30 to place a bet on the roulette table having the identification IDR1, the server carries out certain validation steps:

(a) the server checks that the roulette table having the identification IDR1 is open;

(b) the server checks that the roulette table having the identification IDR1 is in a state for receiving bets, i.e., in the "place bets" state or in the "finish betting" state;

(c) the server checks that the requested bet complies with the current bet thresholds set for the roulette table IDR1.

E3. The server 10 checks its mobile gaming device credit list 11 to determine if the credit balance assigned to the tablet computer having the identification IDT1 is sufficient to cover the bet. This check may optionally be carried out before the checks set out in step E2.

E4. If the server 10 determines that the credit balance assigned to the tablet computer having the identification IDT1 is not sufficient to cover the bet, the server sends a message to the tablet computer having the identification IDT1 across the wireless network 30 causing the tablet computer to display the legend "Bet refused, reason: insufficient funds" on the tablet computer's user interface 53.

E5. If the server 10 determines that the credit balance assigned to the tablet computer having the identification IDT1 is sufficient to cover the bet, it stores the bet and adjusts the credit balance of the tablet computer accordingly in its mobile gaming device credit list 11. The server sends a message to the tablet computer causing it to adjust the displayed credit balance to correspond with the balance now held in the gaming device credit list 11. The server sends a message to the tablet computer having the identification IDT1 across the wireless network 30 causing the tablet computer to display the bet on the betting area graphic 54 of the tablet computer's user interface 53.

E6. If the tablet computer having the identification IDT1 is docked at one of the docking stations 65 of the roulette table having the identification IDR1, the server 10 sends a message to the roulette table having the identification IDR1 across the secure network 20 causing the roulette table to display the bet on the table's betting display area 64, using the chip colour corresponding to the docking station 65.

E7. The server 10 executes a repetitive loop of steps E2 to E6 while players keep betting until the state of the roulette table having the identification IDR1 changes to the "no more bets" condition or until the credit balance of their tablet computer is depleted to a level that cannot support further bets.

E8. When the server 10 receives a message from the roulette table having the identification IDR1 across the secure network 20 that the roulette table state has changed to the "no more bets" condition, the server 10 sends a message to the tablet computer having the identification IDT1 across the wireless network 30 telling the tablet computer to display the legend "no more bets" on the betting area graphic 54 of the tablet computer's user interface 53.

E9. The server 10 waits for a message from the roulette table having the identification IDR1 across the secure network 20 telling the server the winning number as determined by the roulette table's result detector 63.

E10. The server 10 sends a message to the tablet computer having the identification IDT1 across the wireless network 30 telling the tablet computer to display the result in the result graphic 55 on the tablet computer's user interface 53.

E11. The server 10 determines winning bets for each mobile gaming device playing the current game.

E12. The server 10 sends a message to the tablet computer having the identification IDT1 across the wireless network 30 causing the tablet computer to highlight winning bets on the betting area graphic 54 of the tablet's user interface 53.

E13. The server 10 credits the account of each mobile gaming device that placed a winning bet and adjusts its mobile gaming device credit list 11 accordingly.

E14. The server 10 sends a message across the wireless network 30 to each mobile gaming device that placed a winning bet causing the mobile gaming device to update the balance graphic of its user interface.

E15. The server 10 increments the game number to commence the next game. The server 10 sends a message to the roulette table having the identification IDR1 across the secure network 20 telling the roulette table to remove the bets for the game just concluded from the table's betting display area 64. Incrementation of the game number occurs before the state of the roulette table having the identification IDR1 can be changed to the "place bets" condition.

Additional Embodiments

In the foregoing detailed description, the roulette table 60 is described as having a plurality of docking stations 65 for removably receiving mobile gaming devices such as the tablet computer system the. In a variant, the docking stations 65 may have a built-in touchscreen that can be utilised by a player positioned at the docking station who wishes to play the live game even though he does not have a mobile gaming device to dock with the docking station. In this variant, bets placed using the docking station's built-in touchscreen are communicated to the server across the secure network. However, when a mobile gaming device is docked at the docking station, the docking station's built-in touchscreen is rendered inoperative and communications between the server and the docked mobile gaming device are made over the wireless network as described previously.

In another variant, the roulette table 60 with its wheel 62 may be a "master" roulette table and there may be one or more associated "slave" roulette tables that do not have their own wheels but nevertheless allow the live roulette game played at the master roulette table 60 to be followed. The slave roulette tables may be able to accommodate additional docking stations in place of the absent roulette wheel, or they may simply be shorter versions of the master roulette table 60, truncated at the point where the wheel would have been positioned. The progress of the live game taking place on the master roulette table 60 is conveyed to the slave roulette tables by the server across the secure network 20 and the docking stations provided at the slave roulette tables communicate with the server across the secure network 20 in the same way as the docking stations of the master roulette table 60. However, mobile gaming devices docked at the docking stations of the slave roulette tables communicate with the server 10 across the wireless network 30 in the same way as mobile gaming devices docked at the docking stations of the master roulette table 60.

In the illustrated embodiments, the crediting device for "recharging" the credit on a tablet computer 50 is a top-up kiosk. The top-up kiosk may be permanently fixed at a particular location, and may be floor-standing or may be mounted to a wall in an insulation resembling a conventional ATM machine. In alternative embodiments, it is foreseen that the crediting device may be a mobile or portable device. In one mobile embodiment of the crediting device, the top up-kiosk 40 shown in FIG. 2 may simply be mounted on a wheeled base, so that it can be positioned at a convenient location, and optionally secured in place by applying brakes to the wheels, or by securing the kiosk to a fixed structure.

The crediting device may alternatively be a hand-portable device which a member of the casino staff may bring to a player's location to enable the player's tablet computer 50 to be docked with a docking station of the portable crediting device and "recharged" with credit in a manner similar to that described in relation to crediting a tablet computer 50 using the top-up kiosk 40. The crediting device may communicate with the server over a secure wireless network, and may have cash receptors and/or credit card receptors for the player to make payments either in specie or by using a credit card.

The identification tags used in the foregoing detailed description are RFID tags. However, alternative forms of identification tag could be used, for example barcodes. In these circumstances, the identification tag readers provided at the system docking stations will be barcode readers. Increasingly, mobile communication devices are equipped with near field communication (NFC) capability, so another alternative form of tagging would be using NFC tags. In a further alternative, the mobile computing device may be provided with a Bluetooth® wireless communication capability, which requires a unique identification code. The docking station of a gaming table or of the credit top-up device may utilise the Bluetooth wireless code as an identifier for the mobile computing device. All that is required is that the mobile devices and the static devices of the gaming system be uniquely identifiable and that mobile devices, in particular, be identifiable when docked.

The foregoing detailed description relates to the example of a roulette game, but it will be understood by persons skilled in the art that the underlying technology is equally applicable to other casino wagering games, for example card games such as baccarat, poker and blackjack, dice games such as craps or Sic Bo, and other games such as "Wheel of Fortune"-type games such as for example "Big Money Wheel".

Figure 6:
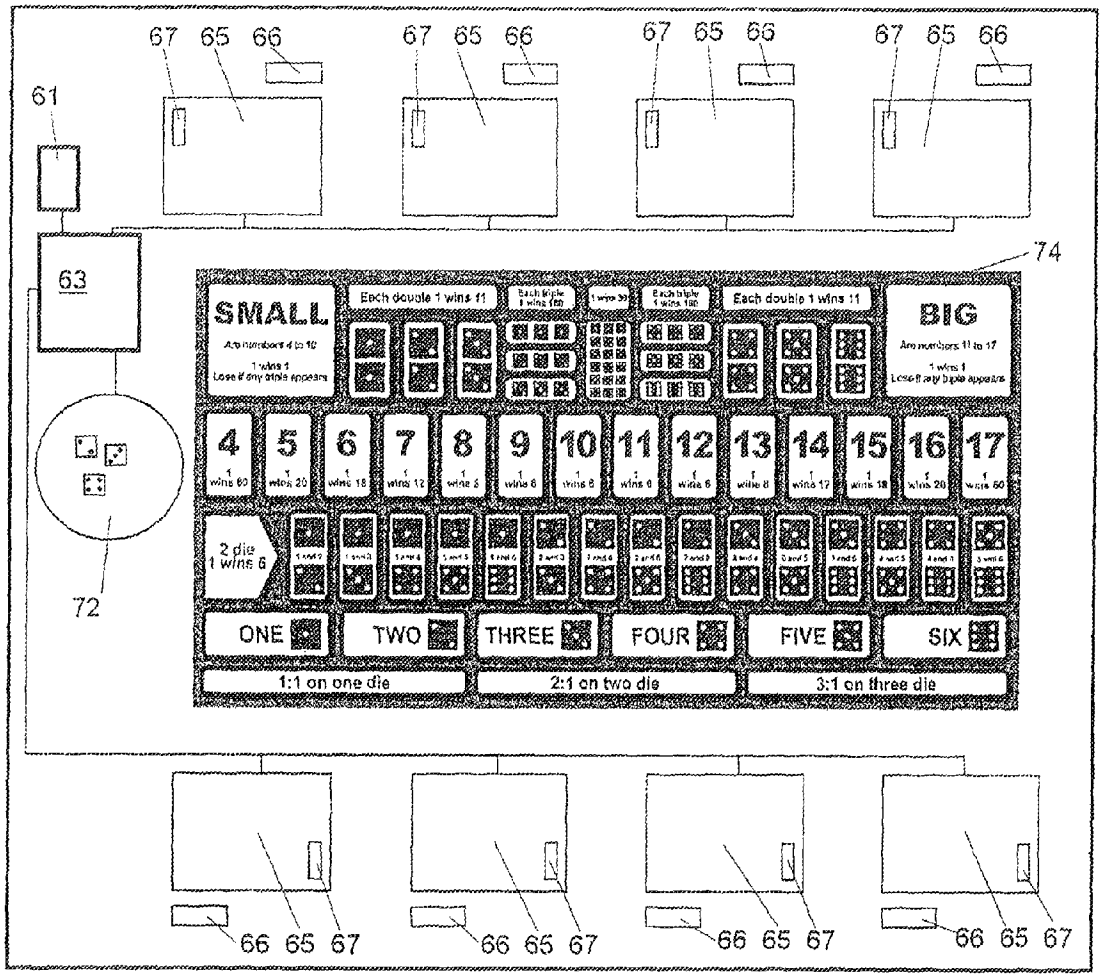
FIG. 6 is a view similar to FIG. 4 showing a table layout for playing the dice game "Sic Bo"

FIG. 6 illustrates, in plan view, an embodiment of the invention adapted for playing the dice game "Sic Bo". The gaming table has an overall form similar to the roulette table of FIG. 4, but in place of the roulette wheel 62 is a dice shaker 72 containing three dice, and in place of the roulette betting display 64 is a "Sic Bo" betting grid 74 which comprises a number of fields corresponding to the various outcomes possible when shaking three dice. The table has docking stations 65 similar to those described in relation to the roulette table 4, with RFID detectors 67 and docking station identification encoded in software in files 66.

When a tablet computer 50 is docked to one of the docking stations 65 of the gaming table, the user interface 53 of the tablet computer 50 shows the "Sic Bo" betting grid in place of the roulette grid, and wagers are placed in the same way as has been described in relation to the roulette game, with the user selecting a wager value and then selecting a field of the "Sic Bo" betting grid on which to place the bet. Wager amounts and selections are communicated to the server in the same way as described above, and the user interface may have a panel similar to the panel 55 of FIG. 3 to display the result of a dice roll. When all players have placed their wagers, the dice shaker 72 is operated and the result of the dice roll communicated to the result detector 63, and winning and losing bets are resolved.

Adjustment of credit balances as wagers are placed and bets won, and display of available credit, are substantially as described above in relation to the roulette game.

In place of the automatic dice shaker 72, a manual croupier may throw physical dice, and the result of each dice roll may be detected automatically and input to the result detector 63, or may be input by the croupier via an input device (not shown).

Figure 7:
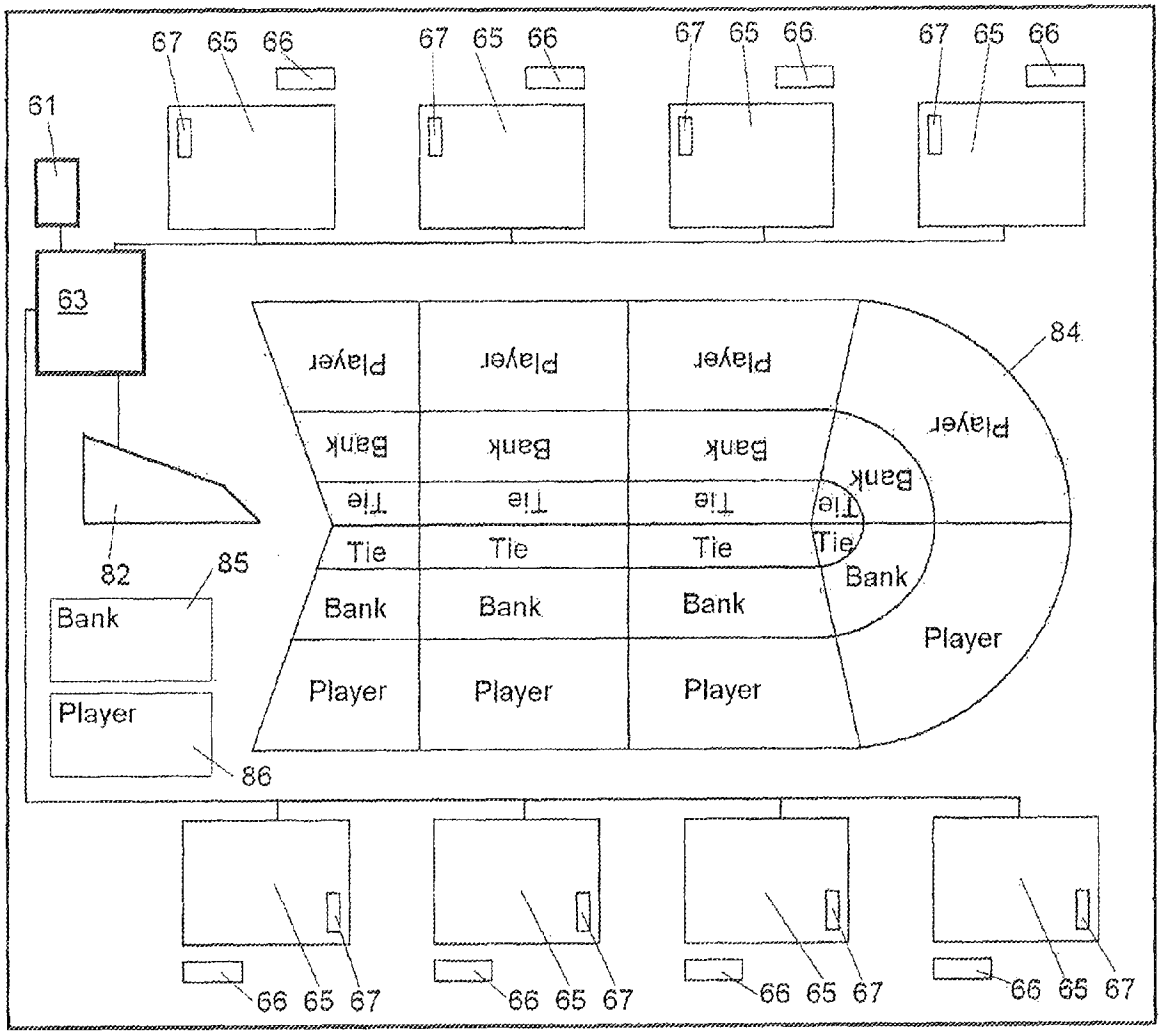
FIG. 7 is a view similar to FIG. 4, showing a table layout for playing the card game Baccarat.

FIG. 7 is a view similar to FIG. 4 and illustrates a further embodiment of the gaming table, adapted to the card game of Baccarat. In this embodiment, an intelligent dealing shoe 82 takes the place of roulette wheel 62, and the betting grid is replaced with a baccarat-style grid 84 in which each player has three options and may bet on "player", "bank" or "tie". The user interface of the tablet computers 50 is arranged to display a number of wagering amounts from which the player can select an amount to be wagered, the three wager selections available to the player, the player's current credit balance, and a winning result.

After all players have placed their wagers, cards are dealt from the shoe 82 into dealing fields 85 and 86 for the "player" and the "bank" hands, respectively. The dealing shoe communicates the values of the cards to the result detector 63. The detector 63 may determine the winning result from the card values and the order in which they were dealt. Alternatively, the information on the order and values of the cards dealt may be forwarded to the server 10, which then determines the winning result. As before, each player's wager may be displayed on the grid 84.

In an alternative to the use of physical playing cards and a dealing shoe, the dealing fields 85 and 86 may be display fields which can display images of cards which form the "player" and the "bank" hands to the players seated at the table. The server 10 may generate data to determine which cards are dealt to which hand, and send the data to the table for display on display fields 85 and 86.

Likewise, the physical roulette wheel 62 shown in FIG. 4, and the physical dice shaker 72 shown in FIG. 6 may be replaced by a graphic video display illustrating a roulette wheel or dice shaker, controlled from the server 10 to show wheel spins or dice shakes on a random basis.

The invention can also be adapted to wagering games such as blackjack or poker, where the result is influenced by player input. In these embodiments, commands are input using the tablet computer interface by the player during play to hit or draw more cards, to exchange cards, and/or to increase the wagered amount before a final result of the round of play is reached.

What is claimed is:

1. A system comprising:

a gaming table to manage a wagering game for which wagering data may be entered using at least one of a plurality of mobile computer devices, the gaming table comprising:

a plurality of docking stations each adapted to receive a respective one of the plurality of mobile computer devices; and a display to display the wagering data received from the plurality of mobile computer devices;

at least one credit entering kiosk for entering credit in association with a first mobile computer device of the plurality of mobile computer devices presented to the credit entering kiosk, the at least one credit entering kiosk configured to:

detect identity data of the first mobile computer device; and determine a credit amount associated with the first mobile computer device; and a server communicatively coupled to the at least one credit entering kiosk, the server comprising:

a memory to store:

data defining the wagering game performed at the gaming table, the wagering data placed via the plurality of mobile computer devices, and a credit value defining credit available for the playing of the wagering game utilizing the associated mobile computer device, a processing device to:

receive, from the at least one credit entering kiosk, the credit amount associated with the first mobile computer device;

adjust the credit value to a current credit value to take account of the wagering data placed utilizing the associated mobile computer device; and in response to the first mobile computer device being docked at the at least one credit entering kiosk, adjust the credit value associated with the first mobile computer device based on the credit amount;

and wherein the system is operable to:

transmit, to each of the plurality of mobile computer devices via the wireless telecommunications network, the wagering data and the current credit value associated with each of the plurality of mobile devices;

transmit, from each of the plurality of mobile computer devices to the server, the wagering data entered via an user interface of each of the plurality of mobile computer devices, and display the wagering data transmitted to the server from the plurality of mobile computer devices.

2. The system of claim 1, wherein each mobile computer device comprises at least one of radio-frequency identification (RFID tag), an optically readable barcode, or a near field communication (NFC) device.

3. The system of claim 1, further comprising an apparatus for playing the wagering game.

4. The system of claim 3, wherein the apparatus for playing the wagering game is a roulette wheel.

5. The system of claim 3, wherein the apparatus for playing the wagering game is a card dealing shoe.

6. The system of claim 3, wherein the apparatus for playing the wagering game is a dice shaker.

7. The system of claim 1, wherein the credit entering kiosk comprises:

a dock to receive a mobile computer device presented thereto;

a detector to detect the identity data of the at least one of the plurality of mobile computer devices presented thereto;

a credit receiver to receive the credit amount associated with a detected mobile computer device; and a communicator to communicate with the gaming table the identity data of the detected mobile computer device and the credit amount.

8. The system of claim 7, wherein the at least one credit entering kiosk comprises at least one of a coin receptor, a banknote receptor or a credit card receptor.

9. The system of claim 7, wherein the at least one credit entering kiosk comprises a mobile device, and wherein the communicator comprises a wireless communicator.

10. The system of claim 1, wherein the system is further operable to permit the entry of the wagering data in the wagering game taking place at the gaming table by the plurality of mobile computer devices when at least one of the plurality of mobile computer devices is remote from the gaming table.

11. The system of claim 1, wherein each of the plurality of mobile computer devices comprises an identifying device to transmit the identifying data; and wherein each of the plurality of docking stations comprises an interrogating device operatively coupled with the identifying device of at least one of the plurality of mobile computer devices to receive the identifying data.

12. The system of claim 1, wherein each of the plurality of docking stations is configured to accept mobile computer devices of different sizes and aspect ratios.

13. The system of claim 1, wherein each docking station comprises a charger configured with at least one of the plurality of mobile computer device presented to the docking station to recharge a battery of the docked mobile computer device.

* * * * *